US005713205A

United States Patent [19]

Sciocchetti et al.

[11] Patent Number: 5,713,205

[45] Date of Patent: Feb. 3, 1998

[54] AIR ATOMIZED DISCRETE JET LIQUID FUEL INJECTOR AND METHOD

[75] Inventors: Michael Bruce Sciocchetti, Schenectady; Warren James Mick, Altamont; Mitchell Reuben Cohen, Troy; William Theodore Bechtel, II, Scotia, all of N.Y.

[73] Assignee: General Electric Co., Schenectady, N.Y.

[21] Appl. No.: 692,563

[22] Filed: Aug. 6, 1996

[51] Int. Cl.[6] ..... F02C 1/00

[52] U.S. Cl. ..... 60/740; 60/39.06; 60/748; 239/403; 239/488

[58] Field of Search ..... 60/39.06, 740, 60/748, 742; 239/403, 474, 463, 487, 488

[56] References Cited

U.S. PATENT DOCUMENTS 4,105,163 8/1978 Davis, Jr. et al. ..... 60/748
4,418,543 12/1983 Faucher et al. ..... 60/748
4,773,596 9/1988 Wright et al. ..... 60/748
5,228,283 7/1993 Sciocchetti .
5,259,184 11/1993 Borkowicz et al. .
5,274,991 1/1994 Fitts .
5,355,670 10/1994 Sciocchetti .

*Primary Examiner*—Charles G. Freay
*Attorney, Agent, or Firm*—Nixon & Vanderhye

[57] ABSTRACT

A liquid fuel injector nozzle for a gas turbine combustor delivers liquid fuel to the combustion chamber in discrete jets. The liquid fuel injector nozzle includes a fuel passage that terminates with a swirl pilot including a plurality of swirl slots for imparting swirl to the liquid fuel. The spin chamber disposed downstream of the swirl pilot is configured to deliver the liquid fuel to the discharge orifice in discrete jets. The discrete fuel streams are concentrated in a fashion to minimize atomization until the fuel adequately penetrates the premixer air stream, resulting in burning properties that lead to increased efficiency, lower emissions, greater flame stability and improved pattern factor when compared to hollow cone spray pattern injection techniques.

8 Claims, 3 Drawing Sheets

AIR ATOMIZED DISCRETE JET LIQUID FUEL INJECTOR AND METHOD

TECHNICAL FIELD

The present invention relates to a fuel nozzle construction for use in gas turbine engines and, more specifically, to a liquid fuel injector in a gas turbine combustor providing multiple discrete fuel jets from a single discharge orifice.

BACKGROUND

A prior art dry low NOx combustor developed for industrial gas turbine applications is described in U.S. Pat. No. 5,259,184, the disclosure of which is hereby incorporated by reference. The combustor is a single stage (single combustion chamber or burning zone) duel mode (diffusion and premixed) combustor that operates in a diffusion mode at low turbine loads and in a premixed mode at high turbine loads. Generally, each combustor includes multiple fuel nozzles, each of which has a surrounding dedicated premixing section or tube so that, in the premixed mode, fuel is premixed with air prior to burning in the single combustion chamber. In this way, the multiple dedicated premixing sections or tubes allow thorough premixing of fuel and air prior to burning, which ultimately results in low NOx levels. The vortex breakdown from the swirling flow exiting the premixers, along with the sudden expansion in the liner, are mechanisms for flame stabilization.

Typically, each fuel nozzle assembly includes a rearward supply section with inlets for receiving liquid fuel, atomizing air, diffusion gas fuel and premix gas fuel, and with suitable connecting passages for supplying each of the above-mentioned fluids to a respective passage in a forward delivery section of the fuel nozzle assembly. An exemplary fuel nozzle is described in U.S. Pat. No. 5,355,670, the disclosure of which is also hereby incorporated by reference. The conventional fuel nozzle arrangement includes structure to swirl the liquid fuel so that the liquid fuel coalesces into an even thin sheet of fuel in the spin chamber prior to being ejected out the discharge orifice. With this arrangement, however, it is difficult to adequately mix the premixer air flow with the liquid fuel prior to burning. The conventional approach of injecting the finely atomized fuel sheet results in poor fuel penetration into the air stream. The relatively low mass/momentum fuel droplets are immediately diverted downstream when impinged upon by the relatively high velocity/momentum air stream. This results in a fuel-rich combustion zone within the combustor, which leads to non-optimal emissions performance.

DISCLOSURE OF THE INVENTION

This invention relates to an improvement in the liquid fuel injector of the fuel nozzle assembly. The structure according to the present invention enables the liquid fuel flowing through the centermost passageway of the fuel nozzle to be discharged as discrete jets as opposed to being discharged after having been coalesced into a sheet. The discrete jet injector liquid fuel streams are concentrated in a fashion to minimize atomization until the fuel adequately penetrates the premixer air stream. The energy contained within the air flow is utilized to perform atomization and mixing. The relative sheer forces between the air and fuel is the mechanism that accomplishes atomization.

It is an object of the invention to provide a liquid fuel injector and method that achieves lower (dry/non-abated) NOx emissions for equivalent overall combustor fuel-to-air ratio; lower diluent (water) injection rate for equivalent NOx emission levels, resulting in a more efficient use of diluent; superior (flatter) exit temperature profile distribution such that heat is not concentrated to the combustor center line, resulting in longer turbine component life; and lower smoke (soot) formation especially at lower fuel flow rates.

These and other objects and advantages according to the present invention are achieved by providing a novel fuel nozzle assembly for a gas turbine combuster. The fuel nozzle assembly includes a plurality of inlets for receiving liquid fuel, atomizing air, diffusion gas fuel and premix gas fuel. A forward delivery section receives the liquid fuel, atomizing air, diffusion gas fuel and premix gas fuel via a plurality of connecting passages and includes a fuel injector nozzle for the liquid fuel and a discharge orifice. The fuel injector nozzle includes a swirl pilot including a plurality of swirl slots and a spin chamber disposed downstream of the swirl pilot that is configured to deliver the liquid fuel to the discharge orifice in discrete jets. The spin chamber is preferably sized to deliver the liquid fuel to the discharge orifice in discrete jets.

In accordance with another aspect of the invention, there is provided a fuel injector nozzle for a gas turbine combustor for delivering liquid fuel to a discharge orifice. The fuel injector nozzle includes a swirl pilot including a plurality of swirl slots, and a spin chamber disposed downstream of the swirl pilot. The spin chamber is configured to deliver the liquid fuel to the discharge orifice in discrete jets.

In accordance with still another aspect of the invention, there is provided a method of injecting liquid fuel into a gas turbine combustor having a combustion chamber and a fuel injector nozzle according to the invention. The method includes the stops of (a) flowing fuel into a fuel passageway of the fuel injector nozzle; (b) swirling the fuel with the swirl pilot; and (c) injecting the fuel in discretion jets into the combustion chamber.

Step (c) is preferably practiced by injecting the fuel before the fuel coalesces into a conical sheet. Step (c) may be practiced by (d) configuring the spin chamber to deliver the fuel in discretion jets. In this regard, step (d) may be practiced by sizing the spin chamber to deliver the fuel in discretion jets.

BRIEF DESCRIPTION OF THE DRAWINGS

These and other aspects of the present invention will become clear in the following description of the invention with reference to the accompanying drawings, in which.

BEST MODE FOR CARRYING OUT THE INVENTION

Reference will now be made in detail to the present preferred embodiments of the invention, an example of which is illustrated in the accompanying drawings.

Figure 2:
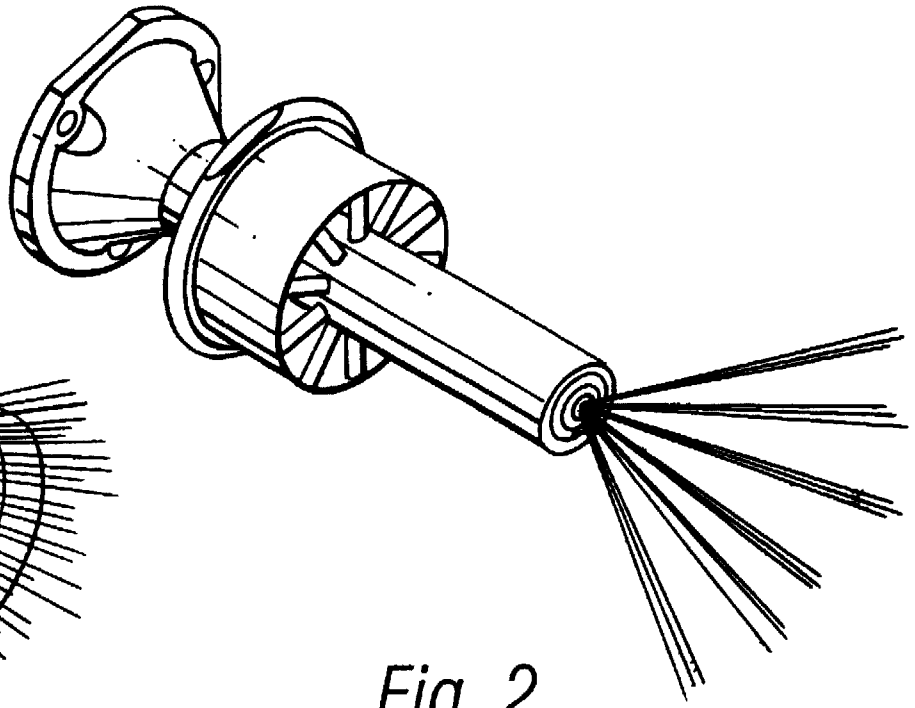
FIG. 2 is a perspective view of the liquid fuel injector nozzle according to the invention.
Figure 1:
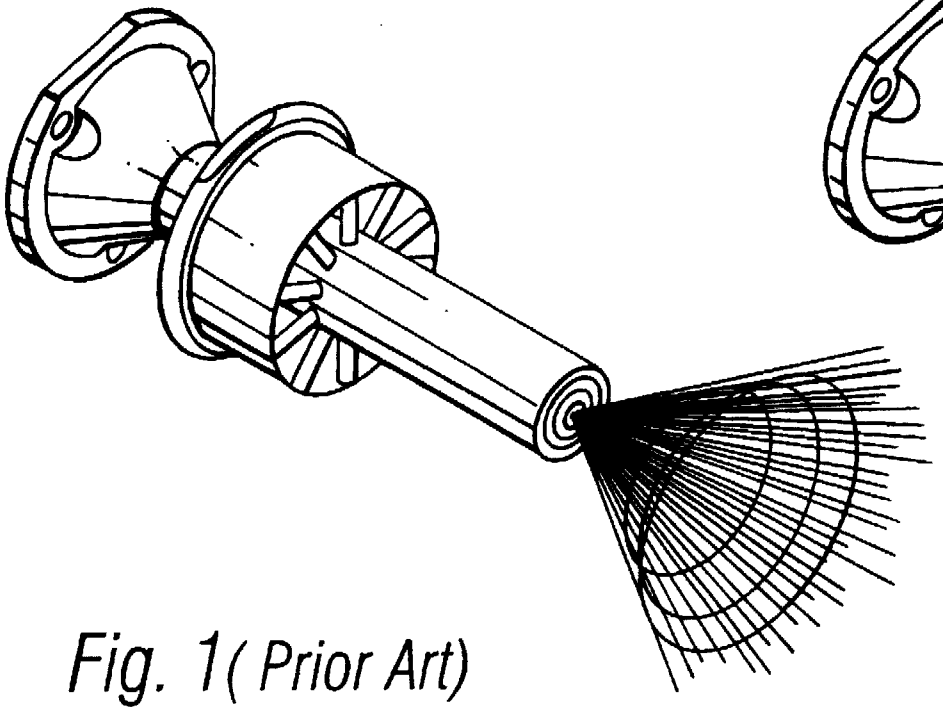
Fig. 1( Prior Art)
FIG. 1 is a perspective view of a conventional liquid fuel injector nozzle.

FIG. 1 illustrates a liquid fuel spray pattern in a conventional liquid fuel injector nozzle. Typically, liquid fuel is introduced into a centermost passageway of the liquid fuel injector nozzle. The liquid fuel is passed through a swirl pilot and into a spin chamber to coalesce the fuel within the spin chamber to an even thin sheet of fuel prior to being ejected through an orifice. As illustrated in FIG. 1, the conventional liquid fuel injector nozzle introduces a conical spray of fuel into the combustion chamber. In contrast, referring to FIG. 2, the liquid fuel injector nozzle according to the present invention is configured such that the liquid fuel is injected before the fuel coalesces into a sheet, thereby remaining as discrete jets at discharge into the combustion chamber. The discrete jet injector liquid fuel streams are concentrated in a fashion to minimize atomization until the fuel adequately penetrates the premixer air stream.

Figure 3:
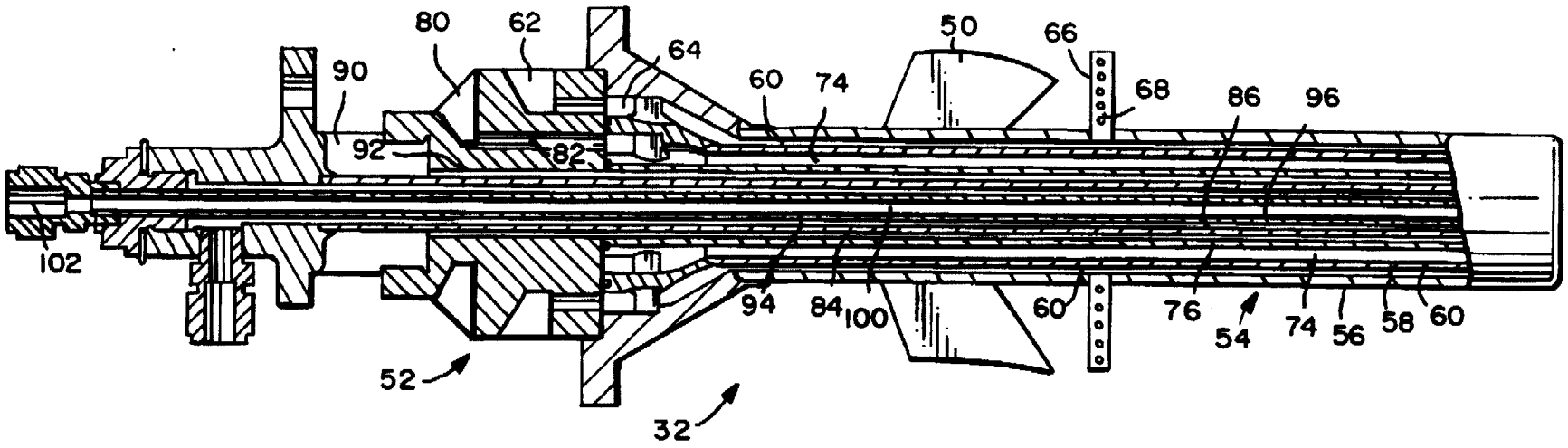
FIG. 3 is a sectional view of the fuel injector nozzle according to the invention.

FIG. 3 is a sectional view of a fuel nozzle assembly including the liquid fuel injector nozzle according to the invention. The fuel nozzle assembly 32 includes a rearward supply section 52 with inlets for receiving liquid fuel, atomizing air, diffusion gas fuel and premix gas fuel, and with suitable connecting passages for supplying each of the above-mentioned fluids to a respective passage in a forward delivery section 54 of the fuel nozzle assembly.

The forward delivery section 54 of the fuel nozzle assembly is comprised of a series of concentric tubes. The two radially outermost concentric tubes 56, 58 provide a premix gas passage 60 that receives premix gas fuel from an inlet 62 connected to the passage 60 by means of a conduit 64. The premix gas passage 60 also communicates with a plurality (for example, eleven) of radial fuel injectors 66, each of which is provided with a plurality of fuel injection ports or holes 68 for discharging gas fuel into a premix zone located within the premix tubes (not shown). The injected fuel mixes with air reverse flowed from the compressor and swirled by means of the annular swirler 50 surrounding the fuel nozzle assembly upstream of the radial injectors 66.

The premix passage 60 is sealed by an O-ring at the forward or discharge end of the fuel nozzle assembly, so that premix fuel may exit only via the radial fuel injectors 66.

The next adjacent passage 74 is formed between concentric tubes 58 and 76 and supplies diffusion gas to the burning zone of the combuster via an orifice at the forwardmost end of the fuel nozzle assembly 32. The forwardmost or discharge end of the nozzle is located within the combustor premix tubes, but relatively close to the forward end thereof. The diffusion gas passage 74 receives diffusion gas from an inlet 80 via conduit 82.

A third passage 84 is defined between concentric tubes 76 and 86 and supplies air to the burning zone via an orifice where it then mixes with diffusion fuel exiting the orifice communicating with passage 74. The atomizing air is supplied to passage 84 from an inlet 90 via conduit 92.

The fuel nozzle assembly 32 is also provided with a further passage 94 for (optionally) supplying water to the burning zone to effect NOx reductions in a manner understood by those skilled in the art. The water passage 94 is defined between the tube 86 and the adjacent concentric tube 96. Water exits the nozzle via an orifice, radially inward of the atomizing air orifice.

Tube 96, the innermost of the series of concentric tubes forming the fuel injector nozzle, itself forms a central passage 100 for liquid fuel which enters the passage by means of an inlet 102. The liquid fuel exits the nozzle by means of a discharge orifice 104 in the center of the nozzle.

Figure 4:
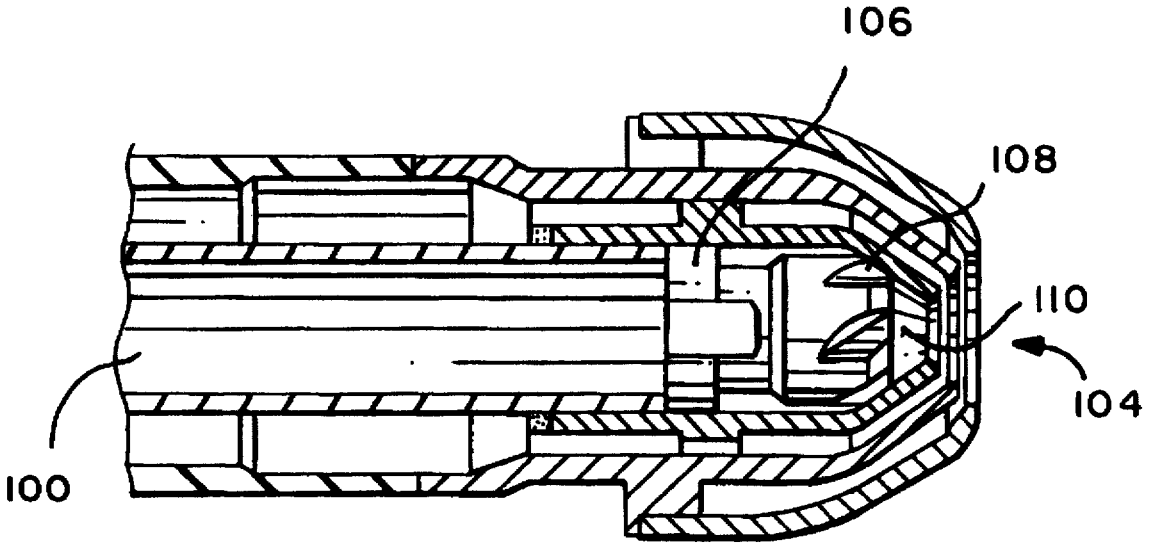
FIG. 4 is an enlarged detail of the discharge or forward end of the nozzle shown in FIG. 3.

Referring to FIG. 4, the fuel central passage 100 terminates at a swirl pilot 106 including a plurality of tangentially oriented swirl slots 108. The swirl slots 108 in the swirl pilot 106 impart a swirling motion to the liquid fuel. The swirling liquid fuel enters a spin chamber 110, which is configured such that the fuel proceeds out of the discharge orifice 104 prior to coalescing into a sheet, thereby remaining as discrete jets at the point of discharge. In a preferred arrangement, the spin chamber 110 is reduced in size so that the swirling fuel has insufficient space to coalesce into a sheet. That is, a conventional spin chamber requires a depth of about 0.095" to enable the fuel to coalesce into a sheet; whereas in accordance with one preferred arrangement of the invention, the spin chamber is provided with a depth of about 0.040", which enables the fuel to be discharged in discrete jets.

In alternative arrangements, the spin chamber may be configured with jet orifices to produce the discrete fuel jets. Of course, those of ordinary skill in the art may contemplate alternative configurations to produce the discrete fuel jets, and the invention is not meant to be limited to the structure that is illustrated and described.

The liquid fuel injector nozzle according to the present invention provides superior liquid fuel-to-air mixing within a premixtype combustor and accomplishes superior emissions performance over comparable diffusion-style combustors. The greater relative momentum of the discrete fuel jets over equivalent flow rate conical spray pattern allows deeper penetration and superior mixing with premixer air stream flow.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A fuel nozzle assembly for a gas turbine combustor, comprising:

a plurality of inlets for receiving liquid fuel, atomizing air, diffusion gas fuel and premix gas fuel; and a forward delivery section receiving the liquid fuel, atomizing air, diffusion gas fuel and premix gas fuel via a plurality of connecting passages, said forward delivery section comprising a fuel injector nozzle for the liquid fuel and a discharge orifice, said fuel injector nozzle comprising:

a swirl pilot including a plurality of swirl slots, and a spin chamber disposed downstream of said swirl pilot, said spin chamber being configured to deliver the liquid fuel to said discharge orifice in discrete jets.

2. A fuel nozzle assembly according to claim 1, wherein said spin chamber is sized to deliver the liquid fuel to said discharge orifice in discrete jets.

3. A fuel injector nozzle for a gas turbine combustor for delivering liquid fuel to a discharge orifice, the fuel injector nozzle comprising:

a swirl pilot including a plurality of swirl slots; and a spin chamber disposed downstream of said swirl pilot, said spin chamber being configured to deliver the liquid fuel to the discharge orifice in discrete jets.

4. A fuel injector nozzle according to claim 3, wherein said spin chamber is sized to deliver the liquid fuel to said discharge orifice in discrete jets.

5. A method of injecting liquid fuel into a gas turbine combustor having a combustion chamber and a fuel injector nozzle including a swirl pilot having a plurality of swirl slots and a spin chamber disposed downstream of the swirl pilot, the method comprising:

(a) flowing fuel into a fuel passageway of the fuel injector nozzle;

(b) swirling the fuel with the swirl prior; and (c) injecting the fuel in discrete jets into the combustion chamber.

6. A method according to claim 5, wherein step (c) is practiced by injecting the fuel before the fuel coalesces into a conical sheet.

7. A method according to claim 5, wherein step (c) is practiced by (d) configuring the spin chamber to deliver the fuel in discrete jets.

8. A method according to claim 7, wherein step (d) is practiced by sizing the spin chamber to deliver the fuel in discrete jets.

* * * * *